US007171958B2

(12) United States Patent
Young

(10) Patent No.: US 7,171,958 B2
(45) Date of Patent: Feb. 6, 2007

(54) NITROUS OXIDE INJECTION SYSTEM

(76) Inventor: Rocklund Young, 1598 Hollipark Dr., Idaho Falls, ID (US) 83401

( * ) Notice: Subject to any disclaimer, the term of this patent is extended or adjusted under 35 U.S.C. 154(b) by 0 days.

(21) Appl. No.: 10/909,863

(22) Filed: Aug. 2, 2004

(65) Prior Publication Data

US 2004/0250804 A1 Dec. 16, 2004

Related U.S. Application Data

(60) Provisional application No. 60/492,068, filed on Aug. 1, 2003.

(51) Int. Cl.
*F02B 1/00* (2006.01)

(52) U.S. Cl. ..... 123/585; 123/531

(58) Field of Classification Search ..... 123/585, 123/531, 1 A; 364/431.05
See application file for complete search history.

(56) References Cited

U.S. PATENT DOCUMENTS

| | | | | |
|---|---|---|---|---|
| 3,964,503 | A | 6/1976 | Kikuchi | |
| 4,081,958 | A | 4/1978 | Schelp | |
| 4,872,424 | A | 10/1989 | Carnes | |
| 5,879,595 | A | 3/1999 | Holtzman | |
| 5,967,099 | A * | 10/1999 | Patrick | 123/1 A |
| 6,055,959 | A | 5/2000 | Taue | |
| 6,105,563 | A * | 8/2000 | Patrick | 123/585 |
| 6,260,546 | B1 * | 7/2001 | Vaughn | 123/585 |
| 6,263,850 | B1 | 7/2001 | Winmill et al. | |
| 6,269,805 | B1 | 8/2001 | Wilson | |
| 6,349,709 | B1 * | 2/2002 | Evert et al. | 123/585 |
| 6,520,165 | B1 | 2/2003 | Steele | |
| 6,523,530 | B2 * | 2/2003 | Evert et al. | 123/585 |
| 6,561,143 | B2 | 5/2003 | Holtzman | |
| 6,564,766 | B2 | 5/2003 | Ayton | |
| 6,592,105 | B1 | 7/2003 | Holtzman | |
| 6,758,198 | B1 * | 7/2004 | Suhre et al. | 123/585 |
| 6,901,888 | B2 * | 6/2005 | Baasch et al. | 123/1 A |
| 6,935,322 | B2 * | 8/2005 | Grant | 123/585 |

* cited by examiner

*Primary Examiner*—Stephen K. Cronin
*Assistant Examiner*—Jason Benton
(74) *Attorney, Agent, or Firm*—Eric M. Barzee

(57) ABSTRACT

A method for increasing the power output of an internal combustion engine is presented. The increase to the power output of the engine may be accomplished by injecting a pressurized oxygen enhancer, such as nitrous oxide, into the air intake of the internal combustion engine. A portion of the pressure derived from the injection is captured by a pressure port. The captured pressure is delivered to the fuel control device of the internal combustion engine such as the float bowl of a carburetor causing an increased quantity of fuel to enter the engine. A manifold for delivering nitrous oxide or another oxygen enhancer to the air intake of an internal combustion engine is also presented.

19 Claims, 8 Drawing Sheets

NITROUS OXIDE INJECTION SYSTEM

RELATED APPLICATIONS

The application is related to and claims priority from U.S. Provisional Patent Application No. 60/492,068, filed Aug. 1, 2003, by Rocky Young and entitled Nitrous Oxide Injection System.

BACKGROUND OF THE INVENTION

1. Field of the Invention

The present invention relates to methods and devices for enhancing the power of an internal combustion engine. More particularly, the present invention relates to methods and devices that enhance the power of an internal combustion engine through the injection of nitrous oxide into the engine.

2. Technical Background

Addition of an oxygen enhancer into internal combustion engines provides large amounts of horsepower by allowing an engine to burn more fuel. One widely used oxygen enhancer is nitrous oxide, which is sometimes referred to as nitrous. Burning more fuel creates more cylinder pressure pushing down on the pistons, which results in more engine power.

Nitrous oxide ($N_2O$) is a colorless, nonflammable gas. When the nitrous oxide is injected into an engine cylinder, the initial combustion within the cylinder creates enough heat to separate the nitrous oxide into its two components, nitrogen and oxygen. Once this separation occurs, the oxygen can then be used to burn more fuel.

However, the extra oxygen the nitrous oxide provides must have fuel to burn or severe engine damage may occur. As a result, supplemental fuel (also know as enrichment fuel) must be added when nitrous oxide is injected into the engine. When the amount of nitrous oxide and the amount of supplemental fuel is controlled, large amounts of power can be made while minimizing the potential of harm to the engine.

Because of this property, nitrous oxide has been used for many years to improve the power output of various engines by increasing the amount of oxygen available for combustion with the fuel. In the 1930s and 1940s, British and German engineers used nitrous oxide to boost the power output of airplane engines. This was especially important when flying at high altitudes with inherently low levels of oxygen available to the airplane engines.

Later, auto enthusiasts adapted the use of nitrous oxide to cars and other vehicles. This provided the vehicle with large boosts in horse power and torque. These boosts in power and torque are particularly important to those seeking quick acceleration. More recently, nitrous oxide has been adapted for use in motorcycles, all-terrain vehicles, and snowmobiles.

While nitrous oxide does increase the power of an engine, some limitations exist with the currently available nitrous oxide systems. Because nitrous oxide increases the amount of oxygen available for combustion, additional fuel is required to combust with the increased oxygen. When nitrous oxide is used it must be in a proper proportion with the fuel. If too much nitrous oxide is fed to the engine without adequate fuel, a lean mixture may result. The lean mixture can cause the engine to run too hot or detonate damaging the engine. The excess heat can cause broken gasket seals, premature failure of rings or pistons, or other types of engine damage. Conversely, if too little nitrous oxide is mixed with the fuel, the excess fuel creates a rich condition that can cause the engine to run poorly.

Other problems with current nitrous oxide injection systems comes from the inherent properties of expanding gases. Systems for injecting nitrous oxide into an engine employ a vessel of compressed nitrous oxide such as a bottle or tank. In its compressed state, nitrous oxide is a liquid. As when other compressed liquids are allowed to expand into a gaseous state, the expansion of nitrous oxide absorbs heat, creating a cooling effect as it expands and transitions from a liquid to a gas. The expanding nitrous oxide can thus create crystals of nitrous oxide ice. This ice can disrupt the flow of the nitrous oxide into the combustion chamber and result in a lean or fuel rich mixture causing the previously mentioned problems with the proper ratio of fuel to nitrous oxide. Moreover, the frozen nitrous oxide does not readily mix with fuel and air.

Another problem with the available nitrous oxide injection systems is that the systems can only be used at full throttle and high RPMs. At low RPMs, the engine can easily become overcharged with nitrous oxide. An overcharged engine may result in broken pistons or other engine damage. In certain nitrous oxide injection systems, the nitrous oxide is forced through the intake without obstruction into the engine cylinder, potentially overfilling the cylinder with nitrous oxide. If the cylinder is overfilled with nitrous oxide, the engine may have extreme combustion forces, detonate, or overheat. Each of these scenarios can cause severe engine damage.

Environmental temperatures also cause problems with many present nitrous oxide injection systems. This is especially true with snowmobiles that are run in extremely cold temperatures. Motorcycles and all-terrain vehicles also may have problems when using nitrous oxide systems in cold or extremely hot temperatures. For example, a snow machine may be run at temperatures exceeding minus 30° F. At these extreme low temperatures, the pressure of the nitrous oxide in the vessel is low. This low pressure may result in a reduced quantity of nitrous oxide being injected.

In other uses such as motorcycles and all-terrain vehicles, the nitrous oxide system may be used in hot summer temperatures exceeding 100° F. At these temperatures, the pressure in the vessel may be high, causing an increased injection of nitrous oxide. In these hot and cold extremes, the flow of the nitrous oxide and/or fuel must be frequently adjusted to compensate for the change in pressure. Additional problems with pressure may result when the vessel is full and has a high pressure and when the vessel is near empty and has a low pressure.

To compensate for these temperature extremes, various devices and methods have been tried. For example, some devices employ a heating or cooling blanket for the nitrous oxide vessel in an attempt to keep the vessel at a constant temperature. Other devices employ expensive computerized systems that attempt to precisely regulate the amount of nitrous oxide flowing from the vessel in a correct ratio with the fuel and RPMs of the engine. Other devices have attempted to vary the fuel to compensate for the change in nitrous oxide pressure. These solutions have proved to be unreliable, overly complex, and costly.

Accordingly, it would be an advancement in the art to provide a system and method for the injection of nitrous oxide into an internal combustion engine that could compensate fuel delivery for the varying pressures in the vessel of nitrous oxide. It would be a further advancement to provide a device and method that would compensate fuel delivery for the varying nitrous oxide pressures created by extreme environmental temperatures. It would be a further advancement if the system and method were simple and cost efficient. It would be a further advancement if the system did not rely on heating or cooling blankets or computerized injection for fuel or nitrous oxide systems.

It would be an advancement in the art to provide a device and method that allow for the proper regulation and mixing of nitrous oxide and fuel, thereby preventing and avoiding engine damage. It would be a further advancement to provide a device and method that optimally mixed quantities of nitrous oxide and fuel in each combustion. An additional advancement would be obtained if the device could limit or prevent the buildup of ice crystals of nitrous oxide.

BRIEF SUMMARY OF THE INVENTION

The present invention relates to methods and devices for increasing the power output of internal combustion engines. Internal combustion engines that may benefit from the increased power created by certain embodiments of the invention include engines installed in motor vehicles including passenger vehicles, recreational vehicles, boats, snowmobiles, motorcycles, all-terrain vehicles, jet-skis, airplanes, and the like.

In one embodiment, a method of increasing the power output of an engine is presented. The method includes the step of injecting a quantity of pressurized nitrous oxide or other oxygen enhancing substance into an air intake of the internal combustion engine. The air intake can be an unfiltered air box or may have a filter. The air intake may also be the an intake for air on intake side of the carburetor or throttle body. In general the air intake is the area from which the engine draws air for combustion with the fuel.

Prior to the injection, the nitrous oxide is pressurized and in a liquid phase. As the nitrous oxide is injected, it rapidly expands and transitions from the liquid phase to a gaseous phase. The expanding pressurized gas increases the pressure in a localized area adjacent the injection site within the air intake.

The method may also include sensing the increased amount of nitrous oxide in the air intake. This sensing is followed by increasing the flow of fuel to the internal combustion engine in a proportionate response to the amount of nitrous oxide in the air intake.

The sensing may occur by capturing a portion of the localized pressure created by the injection. The captured pressure can be delivered to a fuel control device. The pressurized nitrous oxide may exert a pressure on the fuel control device. An increased pressure on the fuel control device can result in an increase in the flow of fuel entering the combustion chamber of the engine.

Additionally, an electronic sensor may be placed within the air intake adjacent the injection site. Such an electronic sensor can be configured to sense an increase in pressure adjacent to the injection site and signal a fuel control device to provide a corresponding increase in fuel to the engine. Such electronic sensors may directly signal a fuel injection system to inject additional fuel. Other electronic sensors may control the pressure on a carburetor float bowl or exerted by an altitude compensation device.

In another configuration, the present invention relates to a method for delivering a proportioned quantity of nitrous oxide and fuel to an internal combustion engine. The method may include injecting a quantity of nitrous oxide into an air intake of the internal combustion engine. A portion of the pressurized nitrous oxide that is injected into the air intake may be captured by a pressure port positioned within the air intake. The captured pressurized nitrous oxide exerts a pressure that can be delivered to a fuel control device of the engine. The pressurized nitrous oxide exerts a pressure on the fuel control device causing an increased quantity of fuel, proportionate to the pressure of the nitrous oxide, to enter the internal combustion engine when a throttle is opened.

The increased amount of fuel is proportionate to the nitrous oxide entering the air intake. As the pressure in the vessel of nitrous oxide drops or increases because of the temperature or volume of the compressed nitrous oxide in the bottle, a corresponding increase or decrease in pressure can be sensed by the fuel control device and an increased or decreased volume of fuel can be released. This method allows for the fuel to be optimally proportionate to the amount of nitrous oxide entering the air-intake and being transferred to the combustion chamber.

The pressure sensor can be a fuel control device that is configured to increase or decrease the flow of fuel in response to a corresponding increase or decrease of pressure exerted upon it. For example, the fuel control device can be a float bowl of a carburetor. As the pressure exerted by the captured nitrous oxide is applied to the float bowl, an increased flow of fuel to the combustion chamber results. Additionally, the fuel control device can be an altitude compensating device configured to exert a positive or negative pressure on the fuel float bowl and thereby increase or decrease the flow of fuel through the carburetor to the engine. The pressure from the injected nitrous oxide can be applied to the pressure from the altitude compensating device and create an increase to the flow of fuel. In other embodiments, the fuel control device can be a fuel pressure regulator or a electronic pressure sensor or other sensor configured to sense the localized pressure increase from the injected nitrous oxide.

In certain embodiments, the nitrous oxide can be injected into the air intake portion of the engine through apertures in a nozzle constructed from a thermally insulating material. The method of the present invention may also be practiced with a device with a plurality of apertures in a nozzle constructed from a thermally insulating material. The thermally insulating material insulates the device and the liquid nitrous oxide from the cooling effects of the expansion and phase change of the injected nitrous oxide that limits the formation and buildup of ice crystals, including nitrous oxide ice or ice due to condensation.

In another aspect of the invention, a manifold for delivering nitrous oxide to an air intake of an internal combustion engine is presented. The manifold can have a nitrous oxide inlet configured to be attached to a vessel of nitrous oxide. The inlet allows the flow of nitrous oxide from the vessel into the manifold. A first nozzle is positioned within the manifold so that it is connected to a nitrous oxide inlet. The nozzle may have one or more aperture. These apertures are configured to receive the pressurized nitrous oxide from the nitrous oxide inlet and spray the pressurized nitrous oxide into the air intake of the engine.

The pressurized nitrous oxide is stored in a liquid phase in the bottle. The liquid form of the nitrous oxide is maintained as the nitrous oxide flows to the manifold and into the nitrous oxide inlets. However, as the nitrous oxide is sprayed though apertures in the nozzle, its rapid expansion causes a phase change from liquid nitrous oxide to gaseous nitrous oxide. The injection and expansion of the nitrous oxide within the air intake of the engine exerts a positive pressure on the nitrous oxide vapor and the air in the air intake creating a localized area of high pressure adjacent to the injection site.

A pressure port can be positioned at a distance from the nozzle and be configured to receive and capture pressure exerted by the pressurized nitrous oxide vapor. This pressure can be transmitted through the pressure port to a pressure conduit and to a fuel control device. This transmission exerts a pressure or force on the fuel control device. The fuel control device may, thus, allow for a greater flow of fuel to the combustion chambers of the engine. The increased fuel may be proportionate to the pressure of the nitrous oxide captured by the pressure ports which is ultimately derived and proportionate to the pressure in the vessel. In certain embodiments, two or more pressure ports may be used to capture a portion of the pressure. These two or more pressure ports may use a single or two or more pressure conduits to transfer the pressure from the ports to the fuel control device. In certain embodiments, the device and method may be adapted to be used with multiple fuel control devices.

The fuel control device can be any device that can sense a change in pressure or that can regulate the flow of fuel in response to a signal from a sensor. However, in general, the fuel control device is a device that regulates and allows for the flow of fuel to the engine. In certain embodiments, the fuel control device can be a fuel float bowl of a carburetor, a fuel pressure regulator, and an altitude compensating device.

It will be appreciated that the manifold may have one or more nozzles configured to spray the pressurized nitrous oxide into the air intake of the engine. Accordingly in certain embodiments, the manifold has a second nozzle in fluid communication with a nitrous oxide inlet. This second nozzle is also configured to spray pressurized nitrous oxide into the air intake through one or more apertures. In other embodiments, the manifold may have three or more nozzles, each in fluid communication with a nitrous oxide inlet and configured to spray pressurized nitrous oxide into the air intake.

The nozzles may have one or more outlets or apertures through which the nitrous oxide is injected. The number of the apertures directly correspond to the power boost provided by a nitrous oxide system. Thus, the number and combination of apertures may be varied depending on the desired power increase. In general, more apertures create a larger increase in power of the engine. Thus, in order to obtain the desired power increase, a first nozzle may have a number of nitrous oxide outlet apertures that is greater than or less than the number of nitrous oxide outlet apertures of another nozzle in the same manifold. In other embodiments, the number of nitrous oxide outlet apertures in each nozzle are equal within a given manifold.

A target plate may be provided, distally positioned from the one or more nitrous oxide outlet apertures of the nozzles. The target plate is configured to intercept the spray of nitrous oxide and to direct and/or concentrate a portion of the nitrous oxide spray into the pressure ports.

The manifold may also have a bleeder valve or other means for reducing the pressure exerted on the fuel control device. A bleeder valve may be provided in fluid communication with the pressure conduit. If it is desired that the pressure on the fuel control device be reduced, the valve may be opened releasing a portion of flow of the captured pressurized nitrous oxide. Otherwise the valve may be closed and the full amount of pressure transferred to the fuel control device.

The nozzle and other elements of the manifold may be constructed from a thermally insulating material. Such materials may be selected for the ability to reduce ice buildup on the manifold caused by the rapidly expanding pressurized nitrous oxide. Such thermally insulating materials include plastic, fiberglass, wood, cellulose, rubber, ceramic, carbon fiber, and a combination thereof.

In certain configurations, the apertures in the nozzles can be formed with a larger opening proximate to the nitrous oxide inlet and with a reduced or tapered opening proximate to the air intake. In this manner, the nitrous oxide remains in its compressed, liquid phase until it exits the reduced portion of the aperture and is injected into the air intake.

In yet another embodiment, the present invention can relate to devices and methods for transiting a substance stored as a liquid to a gas. Thus a manifold may be configured to deliver a quantity of material stored in a liquid phase and to be used in an area. Such areas may be the air intake of a engine as described above or another area where the substance is to be used as a gas. The manifold may have an inlet configured to be attached to a source of the compressed substance. A nozzle can be connected to the inlet and be in fluid communication with the inlet. The nozzle can be configured to spray the compressed substance into the area of use. The area of use may have a temperature and pressure sufficient to transition the compressed substance from a liquid phase to a gaseous phase. A thermal insulator can be provided to insulate the manifold from the cooling effect of the transition of the substance from a liquid phase to a gaseous phase. Such thermal insulators can be plastics, fiberglass, wood, cellulose, carbon fiber, ceramic, rubber, or a combination thereof. Additionally, the nozzle may be constructed of a thermally insulating material thereby insulating the manifold from the cooling effect of the transitioning, expanding substance. The invention may also relate to methods of injecting a substance stored in a liquid phase and to be used in a gaseous phase through a manifold configured to be insulated from the cooling of the transition of the substance.

BRIEF DESCRIPTION OF THE DRAWINGS

A more particular description of the invention briefly described above will be rendered by reference to specific embodiments thereof which are illustrated in the appended drawings. These drawings depict only typical embodiments of the invention and are not, therefore, to be considered to be limiting of its scope. The invention will be described and explained with additional specificity and detail through the use of the accompanying drawings.

DETAILED DESCRIPTION OF THE INVENTION

The presently preferred embodiments of the invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 8, is not intended to limit the scope of the invention, as claimed, but is merely representative of presently preferred embodiments of the invention.

Figure 1:
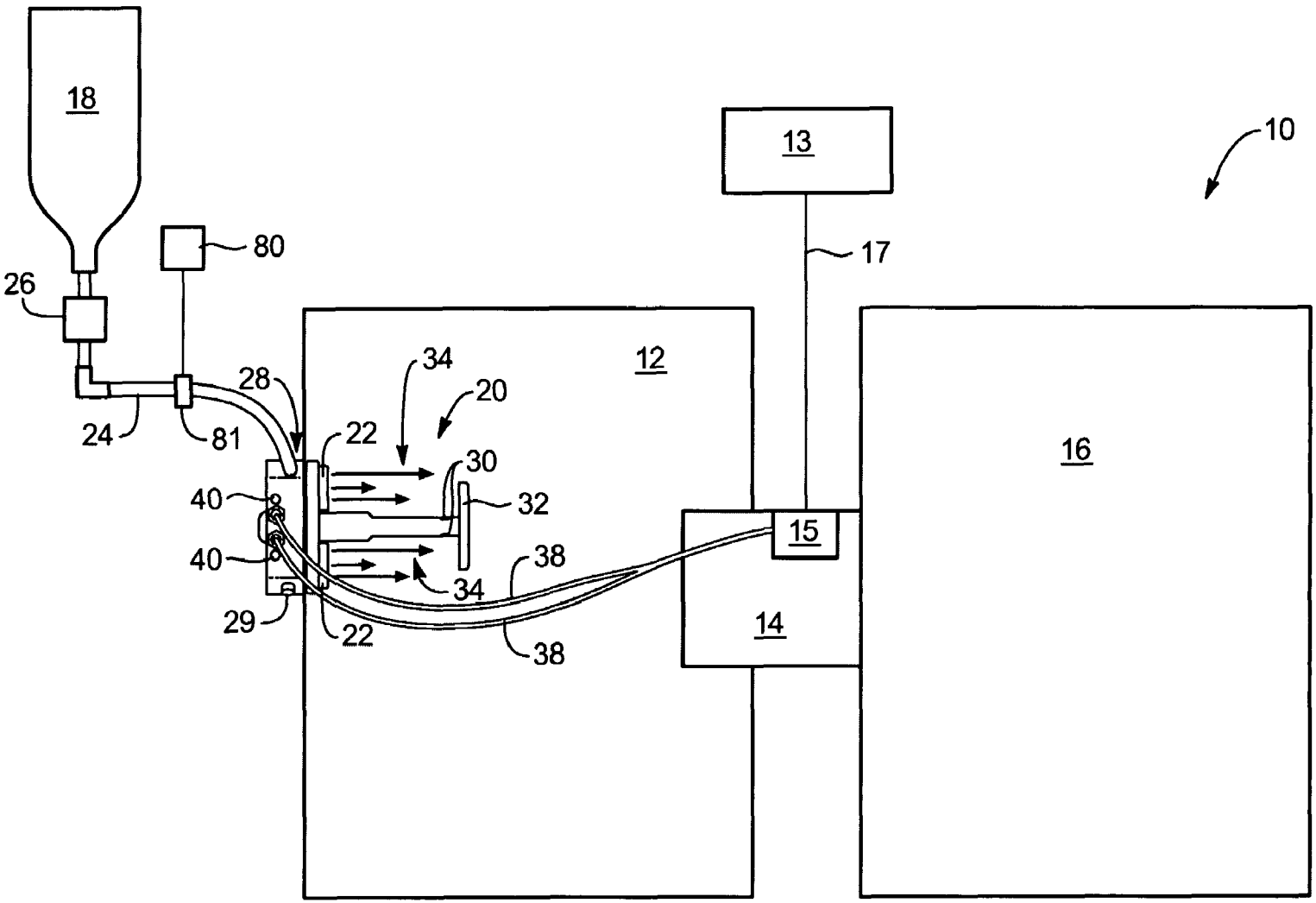
FIG. 1 is a schematic view of a nitrous oxide injection system according to one embodiment of the present invention.

Referring to FIG. 1, a schematic diagram is presented illustrating a nitrous oxide injection system 10 in conjunction with a method of the present invention. A further understanding of the system and method of the present invention may be made by additional reference to FIGS. 2 and 3 for context of the described invention. The system 10 can be used to enhance the power output of an internal combustion engine 16. The system 10 employs a manifold 20 for injecting a compressed oxygen enhancer such as nitrous oxide 34 into the air intake 12 of an engine 10. The nitrous oxide 34 can be stored prior to injection in a compressed, liquid state in vessel 18 such as a bottle or tank.

The methods of the present invention can include the step of transmitting a quantity of a compressed nitrous oxide from a vessel 18 to the nitrous oxide manifold 20. The transmitting may occur by opening a valve 26 and releasing the stored nitrous oxide 34 into transmission lines 24. The valve 26 may be a manually operated mechanical valve or a valve that is operated by electric means such as a solenoid.

In certain embodiments the device may also include a remotely operable valve 82. The remotely operable valve 82 can employ a switch or button 80 that is attached near the throttle, ignition, or other controls of a vehicle in which the nitrous oxide injection system 10 is installed. The remotely operable valve 82 can thus be used to activate the nitrous oxide injection system 10. The remotely operable valve 82 can be opened for short periods of time such as when a power burst is required for rapid acceleration. In certain embodiments, the remotely operable valve 82 is a solenoid or other electronic device. Additionally, the remotely operable valve 82 can be a mechanical valve.

When the nitrous oxide is stored in the vessel and transmitted to the manifold 20 through a transmission line 24, the nitrous oxide is in a compressed, liquid phase. After the valve 82 is opened and the liquid nitrous oxide flows and transmitted from the vessel 18 to the manifold 20. Next, the method includes injecting a quantity of the compressed, liquid nitrous oxide 34 into the air intake 12 of an internal combustion engine 16.

As the liquid nitrous oxide is injected through nozzles 22 of the manifold, it expands rapidly in the lower pressure of the air intake and rapidly transitions from its liquid form to a vapor 34. Within the air intake 12, the vaporous nitrous oxide 34 can mix with the air drawn into the air intake 12. This mixture of air and vaporous nitrous oxide 34 and air can be transferred to the carburetor 14 or combustion chamber of the engine 16 where it is mixed with fuel from the fuel tank 13. The injection takes place as the compressed nitrous oxide is forced through apertures 21 in nozzles 22 or other injection devices of the manifold 20.

A portion 46 of the nitrous oxide vapor 34 and air can be captured within ports 30 distally positioned from the apertures or nozzles 22. Because of the positive pressure in the vessel 18, the nitrous oxide vapor 34 adjacent to the injection site is also pressurized above the normal pressure of the intake. This increased pressure can be captured in pressure ports 30 and transferred through conduits 37, 58, 60, 62 in the manifold 20. These conduits deliver the pressurized, captured nitrous oxide and air mixture 46 and associated pressure through pressure conduit lines 38 to a fuel control device 15 of the engine 16. The captured pressurized gas mixture 38 exerts pressure on the fuel control device 15 causing an increased quantity of fuel to be released from the fuel tank 13 and to enter the engine 16 through a fuel line 17.

The fuel control device 15 may be any device configured to release a quantity of fuel from the tank to the engine 16, or that is configured to regulate the entry of fuel into the combustion chambers of the engine 16. Such devices can be a carburetor 14, a float bowl of a carburetor 15, an altitude compensating device, a fuel pressure regulator, or the like. When the fuel control device includes the float bowl 15 of a carburetor 14, the pressure can be applied directly to the float bowl 15 though lines 38.

In an engine without the nitrous oxide injection system 10 of the present invention, the float bowl is vented to the atmosphere, to the air intake, or to an altitude compensating device. This venting creates a pressure differential between the float bowl and the venturi as air flows through the carburetor 15 to the combustion chamber of the engine. The pressure differential causes the fuel to be drawn through the carburetor to the engine.

In one configuration of the invention, the carburetor is vented to the pressure conduits 38. In this manner, the increased pressure caused by the injection of the nitrous oxide into the air intake 12 is captured by the ports 30 in the manifold and delivered to the float bowl 15. The increase of pressure on the float bowl 15 increases the pressure differential between the float bowl and the venturi causing an increased flow of fuel proportionate to the pressure resulting from the nitrous oxide injection.

Because the pressurized gas 46 captured in the ports 30 is derived from the pressure in the vessel 18 of nitrous oxide, the pressure exerted on the fuel control device 15 is directly proportionate to the pressure in the vessel 18. When the pressure in the vessel 18 is high, a relatively high flow of nitrous oxide is delivered into the air intake 12. When the pressure in the vessel 18 is low, a relatively low flow of nitrous oxide is delivered into the air intake 12.

When the pressure of the captured gas 46 is comparatively higher because of a high pressure in the vessel 18, the pressure exerted on the fuel control device 15 is also relatively high causing an increased flow of fuel into the carburetor 14 and ultimately to the engine 16. When the pressure of the captured gas 46 is lower because of low pressure in the vessel 18, the pressure exerted on the fuel control device 15 is also relatively low causing a decreased flow of fuel into the carburetor 14 and ultimately to the engine 16. This changing pressure exerted on the float bowl 15 allows the system to accommodate fuel flow for the changing pressure and volume of nitrous oxide 34 being injected into the air intake 12 and keeps the nitrous oxide and fuel mixed at optimal ratios.

In certain embodiments, the vessel of nitrous oxide 18 includes a series of interchangeable bottles of pressurized nitrous oxide. The vessel 18 can be coupled to one or more delivery lines 24 that transport the compressed nitrous oxide from the vessel 18 to the manifold 20. The vessel 18 or lines 24 may have a valve 26 that can be closed when the vessel 18 requires replacement or refilling. When this valve 26 is opened, nitrous oxide is released from the vessel 18 and flows into the delivery lines. A second valve 82 can also be placed inline with the vessel 18 or lines 24. This valve 82 can be remotely operable and configured to release the flow of liquid nitrous oxide to the manifold 20.

The pressurized liquid nitrous oxide travels through the delivery lines 24 to the inlets 27 of the manifold 20. The pressurized nitrous oxide is then sprayed into the air intake 12 of the engine through one or more nozzles 22. As the pressurized nitrous oxide expands in the air intake 12, it rapidly changes from a liquid to a vapor and disperses throughout the air intake 12. The nitrous oxide vapor 34 mixes with air within the air intake 12. This mixture of air and nitrous oxide can then flow to the carburetor 14 where it mixes with fuel. The fuel, air, and nitrous oxide mixture is in turn supplied to the engine 16 where the nitrous oxide breaks down into its component elements, nitrogen and oxygen, and combusts with the fuel and air adding additional power to the engine 16.

A portion of the nitrous oxide 34 may strike the target plate 32 and be captured, along with some air, in pressure ports 30. The captured mixture 46 of nitrous oxide and air exerts a pressure that can be transferred through a series of conduits 37, 58, 60, 62 in the manifold 20 to pressure conduit lines 38 and ultimately to a fuel control device 15 such as the float bowl of the carburetor 14. Exerting this pressure on the float bowl causes additional fuel to flow through the carburetor jets.

While the target plate 32 may be placed at any distance from the nozzle 22, optimal performance of the manifold may be accomplished when the target plate 32 is sufficiently distant to limit the formation of nitrous oxide ice on the plate 32. Thus, in certain configurations where apertures 21 are relatively large, the target plate 32 should be positioned further away from the nozzles 22 than in configurations where the apertures 22 are relatively small. Additionally, the further the target plate 32 is positioned from the nozzle 22, the lower the pressure sensed or captured by pressure ports 30. Thus it is anticipated that the pressure captured by the ports 30 may be adjusted in certain configurations by providing a target plate 32 that can be positioned at various distances from the nozzle 22.

When the pressure within the nitrous oxide vessel 18 is high, the pressure captured in the pressure ports 30 and exerted on the float bowl 15 is relatively high causing a correspondingly higher flow of fuel through the carburetor jets. Conversely, when the pressure within the nitrous oxide vessel 18 is low, the pressure captured in the pressure ports 30 and exerted on the float bowl 15 is relatively lower causing a corresponding reduced flow of fuel from the fuel tank 13 into the engine as compared when the pressure in the vessel 18 is high.

This system 10 ensures that the incoming airflow into the carburetor is properly coordinated with the quantity of fuel so as to prevent improper fuel, air and nitrous oxide mixing. In the case of an electronic fuel injection system (EFI), the nitrous oxide may be injected into the air intake device 12. In a system that uses an air box without an air filter, such as a snowmobile, the manifold 10 can be mounted directly to the air box 12. If an air filter is used, the nitrous oxide manifold can be mounted directly to the filter so that nothing obstructs the flow of nitrous oxide to the carburetor 14.

Figure 2:
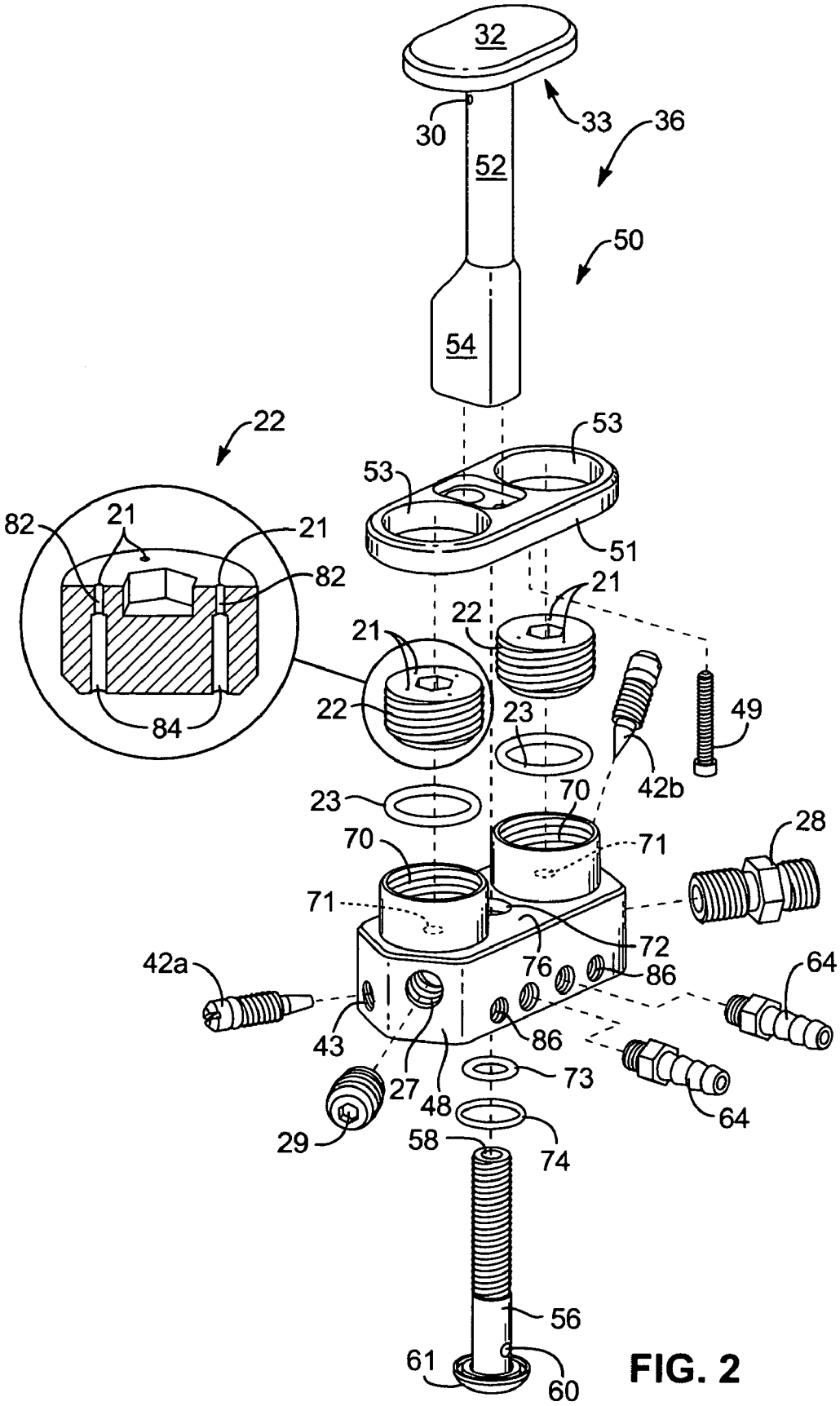
FIG. 2 is an exploded view of a manifold for injecting nitrous oxide into an internal combustion engine in accordance with one embodiment of the present invention.
Figure 3:
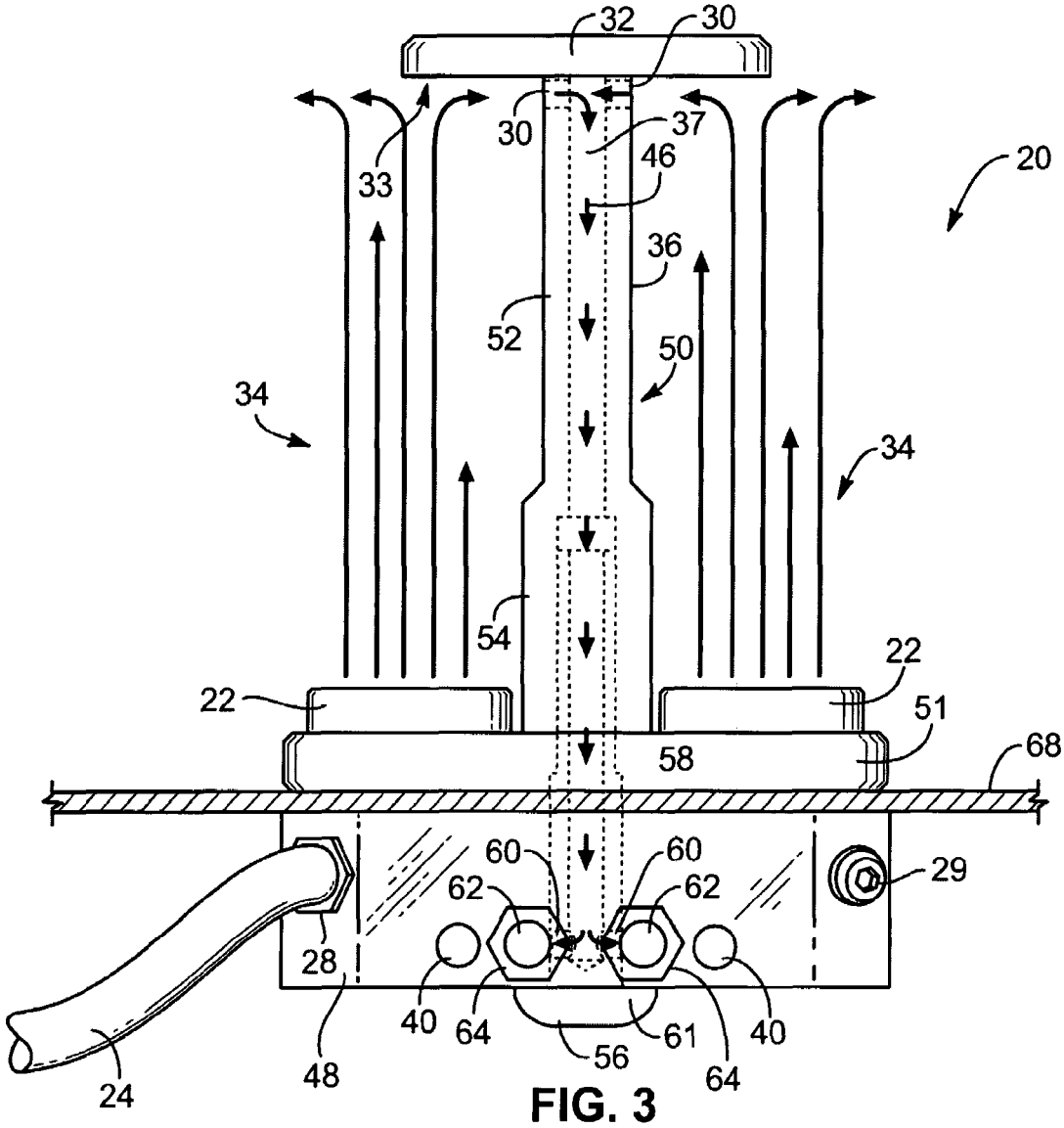
FIG. 3 is a perspective view of one embodiment of a manifold for injecting nitrous oxide into an internal combustion engine.

Referring now to FIGS. 2 and 3 with continued reference to FIG. 1, a manifold for injecting nitrous oxide into the air intake is presented. FIG. 2 illustrates an exploded view of one embodiment of a manifold 20 in conjunction with the system and method of the invention as presented. FIG. 3 is a perspective view of the assembled manifold of FIG. 2 showing the flow of nitrous oxide within the manifold 20 and air intake 12. It will be appreciated that the various manifolds described herein can be constructed in other manners and with other components without departing from the scope of the present invention. The manifolds described herein are only illustrative of the various manifolds that can be used with the system and method of the present invention.

In general, the manifold 20 of FIG. 2 has a base 48 that is configured to house and be connected to various channels and conduits. In the illustrated embodiment, the base 48 is constructed from a piece of machined metal. Various metals can be used with the present invention and can be selected for cost, ease of machining, weight, resistance to corrosion, and other properties that will be apparent to those of skill in the art. For example, in certain embodiments the base 48 may be constructed from aluminum, tin, steel, stainless steel, zinc, copper, brass, and other metals and alloys. In certain embodiments, aluminum is used because of its low cost, resistance to corrosion, and ease of machining. In other embodiments, the base 48 may be constructed of plastic, wood, fiberglass or other material in which channels can be machined or molded.

The base 48 includes means for transmitting the nitrous oxide from the vessel 18 to the air intake 12. Inlet fittings 28 connect the delivery lines 24 to the manifold 48. The inlet fittings 28 can be the screw type fittings shown in the illustrated embodiment or fittings 28 that are glued, welded, soldered, or otherwise attached to the base 48 or may be integral parts of a molded or machined base 48.

The inlet fittings 28 transmit the nitrous oxide into inlet channels 27 in the base. The inlet channels 27 can have apertures 71 that run from a surface 76 of the base 48 to the channels 27. These apertures 71 release the nitrous oxide into the wells 70 extending distally away from the surface 76.

Nozzles 22 can be fitted within the wells 70 and configured to direct a spray of the compressed nitrous oxide into the air intake. In the illustrated embodiment, the nozzles 22 are threaded and configured to be screwed onto corresponding threads in the wells 70. However it will be appreciated that in other embodiments, the nozzles 22 could be secured to the wells 70 by other means such as a friction fitting, mechanical fasteners, and adhesives. Additionally, the nozzles 22 could be made as integral parts of the base 48 or extension arm 50.

To ensure a tight seal of the nozzles 22 within the wells 70, gaskets 23 can be inserted into the wells 70 prior to the installation of the nozzles 22.

The nozzles 22 can be configured to minimize the potential for nitrous oxide ice buildup. To minimize frosting, icing, or the formation of ice crystal on the manifold 20 or within the air intake 12, the nozzles 22 may be constructed of a thermally insulating material. Thus in many embodiments, the nozzles 22 are made from molded or machined plastic. Other materials that may be used for the nozzles 22 include rubber, wood, fiberglass, and other manmade and naturally occurring materials that do not readily conduct heat and provide thermal insulation.

Small apertures 21 in the nozzles serve as nitrous oxide outlets though which the nitrous oxide is sprayed into the air intake 12. The apertures 21 in the nozzles can also be configured to minimize the formation of ice within the air intake 12 or on the manifold 20. A number of small apertures 21 in the nozzles can reduce the formation of ice as compared to a single large aperture of equal volume. Additionally, the apertures 21 can be constructed with a larger opening 84 on the side of the nozzle 22 inserted into the well 70 and a smaller opening 82 on the side of the nozzle 22 adjacent the air intake 12. This restriction of the aperture 21 from a larger opening 82 to a smaller opening 84 at a point just before the nitrous oxide is injected into the air intake 12 ensures that the nitrous oxide does not change phases from a liquid to a gas until the nitrous oxide is injected into the air intake 12.

In an embodiment such as shown in FIGS. 2 and 3 where there are two or more nozzles, the nozzles 22 may each have an equal or unequal number of apertures 21. Thus, in the illustrated embodiment, a first nozzle 22 has three apertures 21 while a second nozzle 22 has four apertures 22. In other embodiments the number of the apertures 21 in each nozzle 22 is equal.

The number and size of the apertures 21 can be varied to change the power increase provided by the nitrous oxide injection system 10. In one present embodiment, the system 10 is configured such that each aperture in a nozzle 22 corresponds to approximately a 5 horse power increase in the engines output. Thus, if a 40 horse power increase is desired, two nozzles 22 may each be provided with four apertures 21. If however, a lesser or greater increase in power is desired, the nozzles may be exchanged for other nozzles that in combination present the desired number of apertures.

The manifold also includes an arm 50 that extends distally away from the base 48. The arm 50 includes one or more pressure ports 30 positioned at a distance from the nozzles 22. The pressure ports 30 can be positioned adjacent to a target plate 32 that deflects and scatters the nitrous oxide 34 as it strikes the underside 33 of the plate 32. The arm 50 can also have a foot 51 and stem made up of a wide body portion 54, narrow neck 52, and a target plate 32. In certain embodiments the entire arm 50 is constructed from a solid piece of plastic or other thermally insulating material. In the illustrated embodiment, the foot 51 and the stem 36 are constructed from separate pieces and joined by a bolt 49 inserted through the foot 51 and fastened in the body 54. In yet other embodiments, the foot 51 can be joined to the rest of the arm 50 by any number of mechanical means known in the art.

As the nitrous oxide 34 strikes the plate 32, a portion of the nitrous oxide is deflected into and captured by pressure ports 30 formed in the neck 52. The pressure ports 30 are effectively conduits that direct a portion of the pressurized nitrous oxide to the hollow core 37 of the stem 36. The hollow core 37 may be formed in the stem 36 by machining or molding techniques known in the art.

The bolt 56, as shown in the illustrated embodiment, serves multiple purposes: fastening the base 48 to the arm 50, transmitting the captured, pressurized gas from the stem 36 to the base, and securing the manifold to the air intake 12 of the engine 16. The hollow core 37 of the stem 36 transmits the pressurized gas 34 down the stem and to the hollow core 58 of the bolt 56 inserted into body 54 of the stem. Outlets 60 near the head 61 of the bolt 56 allow the gas to pass from the bolt to pressure outlets 62. Fittings 64 inserted in the outlets 62 can be attached to pressure conduit lines 38 and transmit the captured gas and pressure to the float bowl 15.

The bolt 56 can also be configured to secure the manifold to the wall 68 of the air intake 12. This system allows for the ready installation and ease of adapting the present system to any engine with an air intake such as an air box or filter. For the installation of the illustrated embodiment, three holes are cut or drilled into the wall 68 of the air intake 12. These holes are cut and spaced to accommodate the outer diameter of the wells 70 and the bolt 56. Thus, the wells 70 of the base 48 can be inserted into the corresponding holes cut into the wall 68. The base 48 is generally positioned on the exterior of the wall 68 with the wells 70 spanning the wall and the nozzles 22 and arm 50 positioned in the interior of the air intake. The arm 50 is positioned on the interior of the air intake with the holes 53 in the foot 51 positioned over the wells 70. The bolt 56 is inserted into the hole 72 in the base 48, through the third hole in the wall 68, and tightened in the body 54 of the arm 50. Gaskets 73, 74 are placed onto the bolt 56 or into a groove (not shown) within the hole 72 to create a tight seal.

In certain uses and embodiments of the system 10, it may be found that too much pressure is being exerted on the fuel control device 15, and thus the fuel and nitrous oxide are mixing in undesired proportions. The manifold thus may include bleeder valves 40 that are configured to release a portion of the captured pressure exerting gas into the environment or air intake. In certain configurations bleeder fittings (not shown) can be inserted into the bleeder passageways 41 and enable the nitrous oxide to be recycled back into the air intake though bleeder lines (not shown) or released into the environment. The bleeder valves 40 can be regulated by bleeder screws 42 inserted into a bifurcated passageway 41, 43 in the base 48. As the screws 42 are tightened into a portion of the bifurcated passageway 43, the valves 40 are closed directing all of the captured gas into outlets 62. However, when the screws 42 are released, the valve is opened releasing a portion of the captured gas out passage way 41 and reducing the pressure exerted on the fuel control device.

Figure 4:
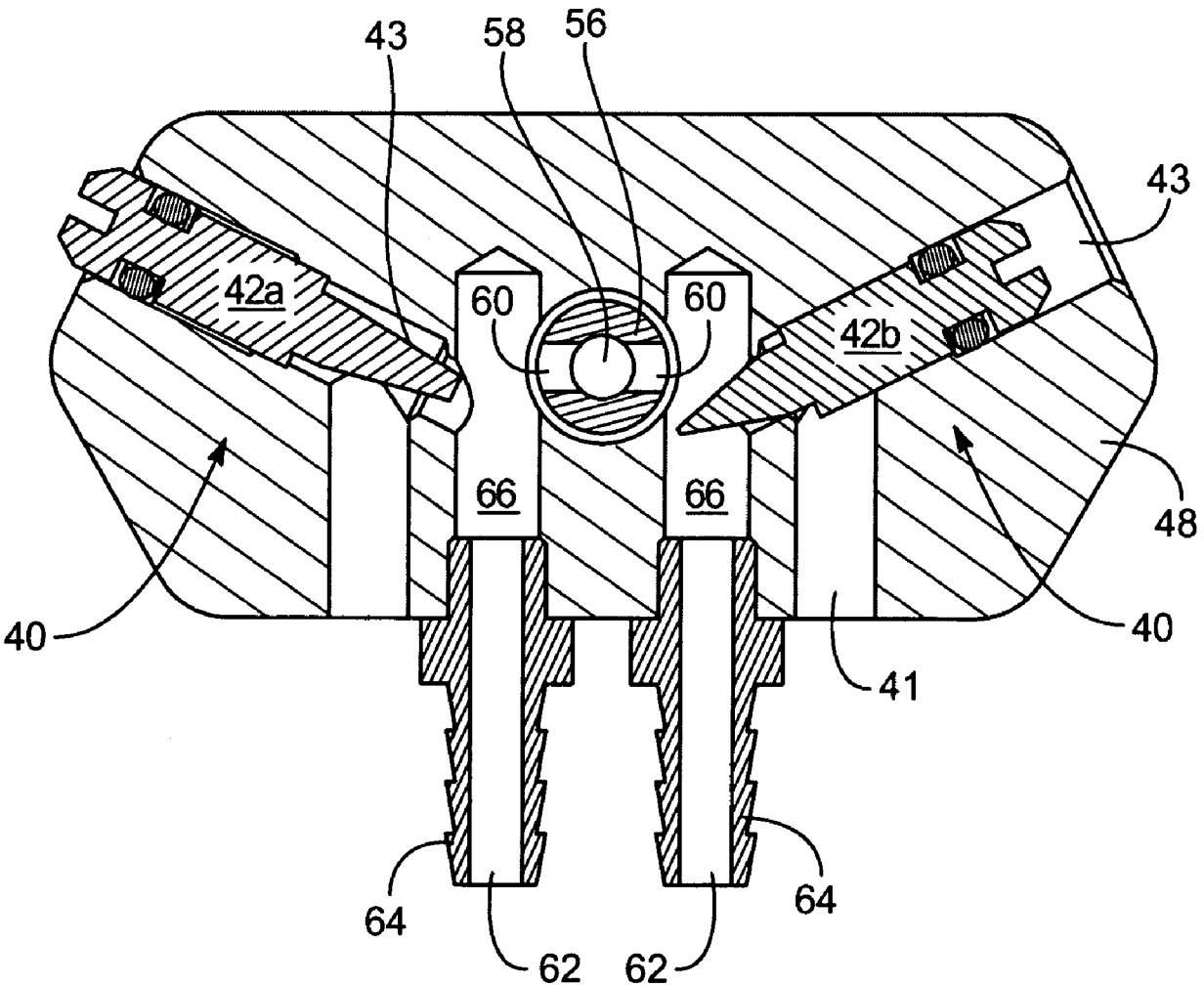
FIG. 4 is a cutaway view of a base of a manifold of the present invention showing various channels and conduits inside the base of the manifold.

Referring now to FIG. 4 with continued reference to FIGS. 1–3, a cutaway view of a manifold of the present invention is presented. In the view of FIG. 4, the interaction of the bleeder valves 40 and pressure outlets 62 of the embodiment of FIGS. 2 and 3 are shown. A bleeder valve 40 has a first channel 41 formed in the base 40 parallel to pressure outlet channel 66. A second bleeder channel 43 is formed at an angle to and intersects the first channel 41 and the outlet channel 66. A bleeder screw 42 can be inserted into the second channel 43. As the screw 42 is tightened and inserted deeper into the channel 43, the screw 42 closes the bleeder channel 41 and closes the hole made in the wall of the outlet channel 66 by the screw channel 43. With the valve 40 in this closed configuration, all pressure captured and transmitted to the bolt 56 flows from its hollow core 58 out the holes 60 and into the outlet channels 66. From there the pressure flows though the fittings 60 and ultimately to the fuel control device 15. When the screw 42 is loosened, the bleeder channel 41 is opened allowing for a portion of the pressure to be released and lessening the pressure exerted on the fuel control device 15.

In certain configurations two types of bleeder screws 42 may be used to provide for either coarse or fine adjustment of the pressure. One example of a screw 42 configured for fine adjustment is shown as 42*a*. This screw has a less taper that that allows for greater range of adjustment by allowing a very small volume of gas to flow with each rotation of the screw 42*a*. A coarse adjustment screw 42*b* can have a pointed, tip with a greater taper allowing for a larger flow from the passageway 60 into the bleeder valve 40 with the same adjustment of the screw 42*b*. Fittings 62 can be inserted into the passageways 60 and configured to transmit the captured air and nitrous oxide 46 to the fuel control device 15.

Figure 5:
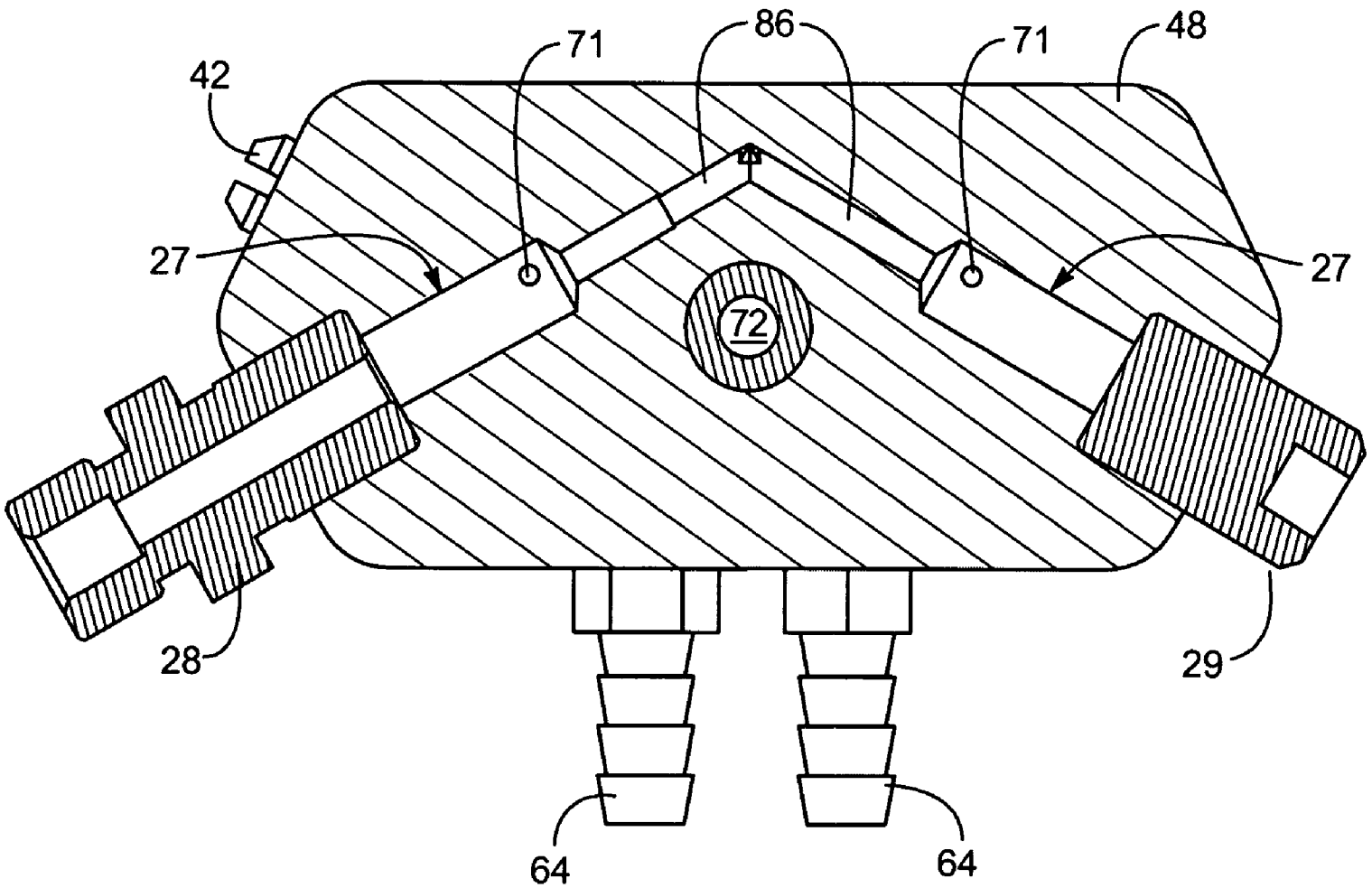
FIG. 5 is an additional cutaway view of the base of FIG. 4 illustrating other channels and conduits within the base.

Referring now to FIG. 5 with continued reference to FIGS. 1–4, an additional cutaway view of the base 48 of the manifold 20 is shown. In this embodiment, inlet fitting 28 is shown inserted into an inlet channel 27 formed in the base 48. The fittings 28 are configured to connect the base 48 of the manifold 20 to the vessel 18 of nitrous oxide through lines 24. The fitting 28 is inserted into the channel 27 where it releases nitrous oxide. Apertures or conduits 71 are formed within the base and run from the wells 70 to the inlet channels 27. These conduits 71 are generally perpendicular to the plane of FIG. 5.

A plug 29 is inserted into one of the two inlet channels 27. When a manifold 20 is installed, inlet lines 24 may interfere with or be blocked by other parts of the vehicle or engine. Thus, the manifold 20 is configured with two inlet channels 27 on opposite ends of the manifold 20. If one channel 27 is obstructed, then a plug 29 can be inserted into the blocked channel 27 and an inlet fitting inserted into the accessible channel 27. Communication channels 86 can be configured to extend beyond the inlet channels 27 and allow for the flow of the liquid nitrous oxide into both conduits 71 and to the nozzles 22.

Figure 6:
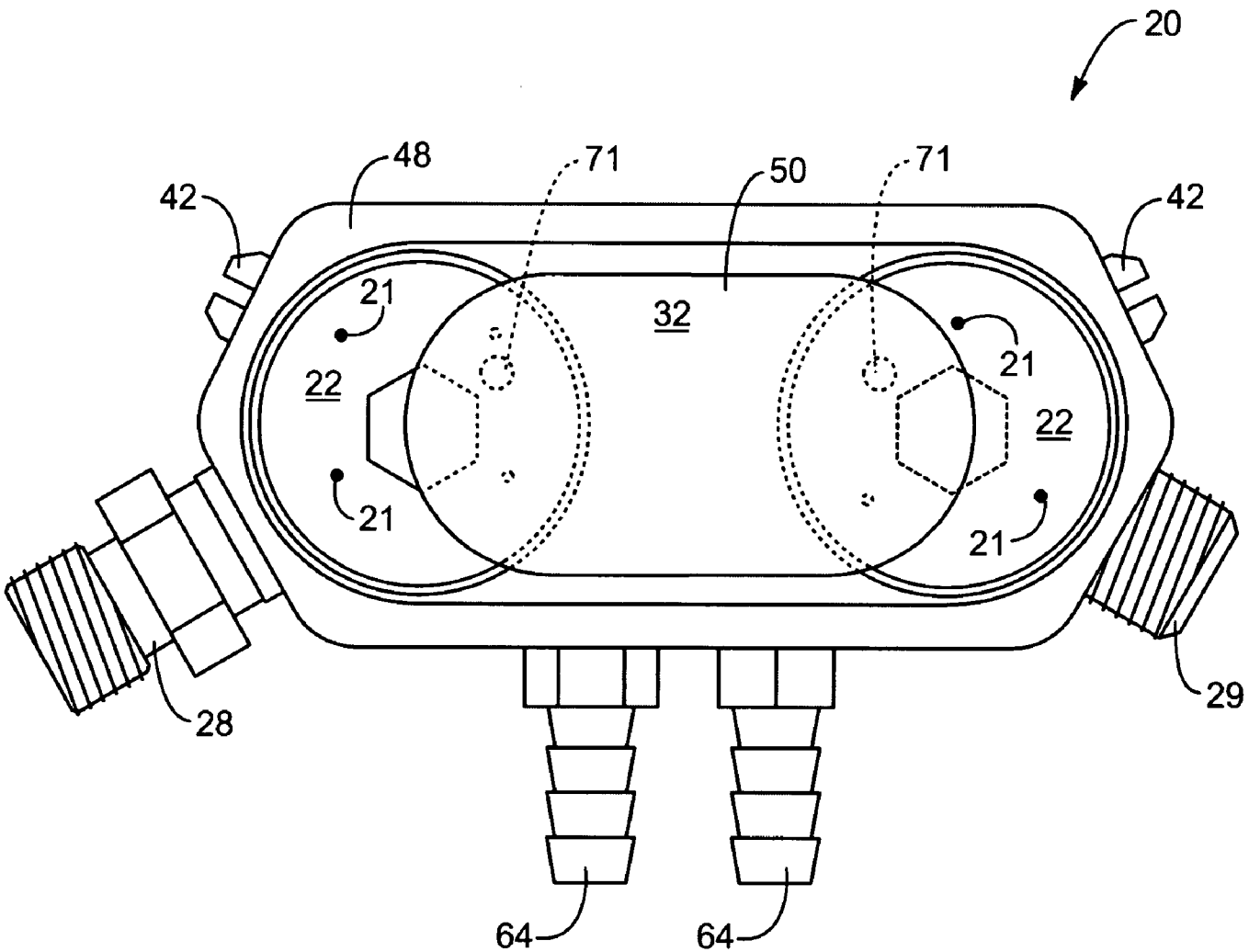
FIG. 6 is top plan view of a manifold of the present invention.

Referring now to FIG. 6, a top plan view of a manifold 20 in conjunction with the present invention is shown. The target plate 32 is shown elevated above the base 48 and its nozzles 22. Each nozzle is shown with a plurality of apertures 21 for spraying nitrous oxide into the air intake 12. The conduits 71 are show in phantom and deliver the nitrous oxide from the inlets 28 to the nozzles 22. The conduits 71 can be machined or otherwise formed to run from the base of the wells 70 to the inlet channels 27.

Figure 7:
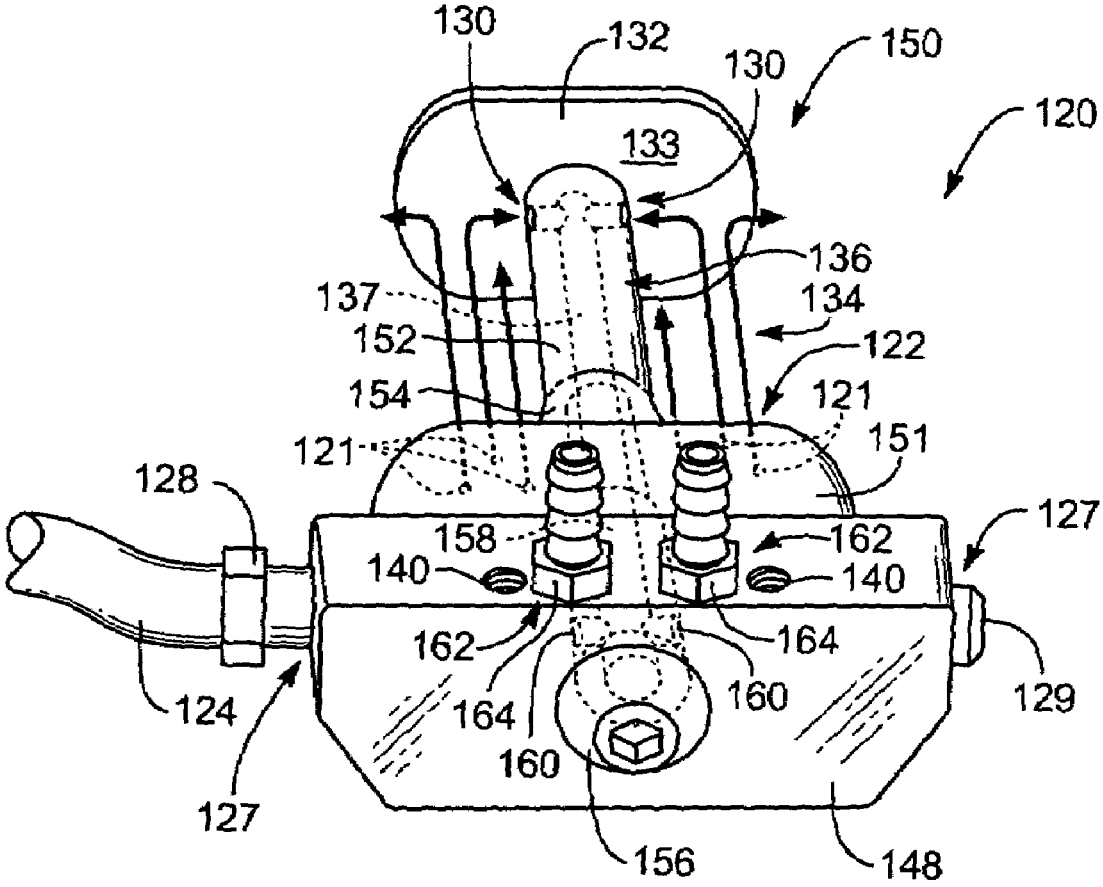
FIG. 7 is a perspective view of an alternative embodiment of a manifold in accordance with the present invention.

Referring now to FIG. 7, an alternative embodiment of a manifold 120 in conjunction with the method and apparatus of the invention is presented. The manifold 120 has a base 148 and an arm 150. The base is illustrated with an inlet line 124 attached to an inlet fitting 128 and configured to deliver liquid nitrous oxide to the manifold 120.

Like the embodiment illustrated above, the arm 150 has a body 154 and a neck 152. The arm 150 further has a target plate 132 and a foot 151. However, in this embodiment, the foot 151 and the stem 136 are constructed from a single piece of thermally insulating material. This configuration requires fewer pieces and may increase the ease of assembly. Moreover, the nozzles 122 and nitrous oxide outlet apertures 121 are integrated parts of the arm 150 further reducing the pieces required for assembly. As with the previously described embodiments, the manifold 120 receives compressed nitrous oxide through transmission lines 124 which is sprayed through the integrated nozzles 122 and apertures 121. A plug 129 may be inserted into one of the inlets 127 allowing the manifold 120 to be installed in many orientations in a vehicle. The sprayed nitrous oxide 134 hits the underside 133 of the target plate and is disbursed into the air intake. A portion of that pressurized gas is captured by the pressure ports 130 positioned in the neck 152 of the stem 136. The stem 136 has a hollow core 137 that transmits the pressure through to the hollow bolt 156, and into the pressure outlets 162. Additionally, bleeder valves 140 can operate to release any portion of the captured pressure and reduce the pressure exerted on the fuel control device.

Figure 8:
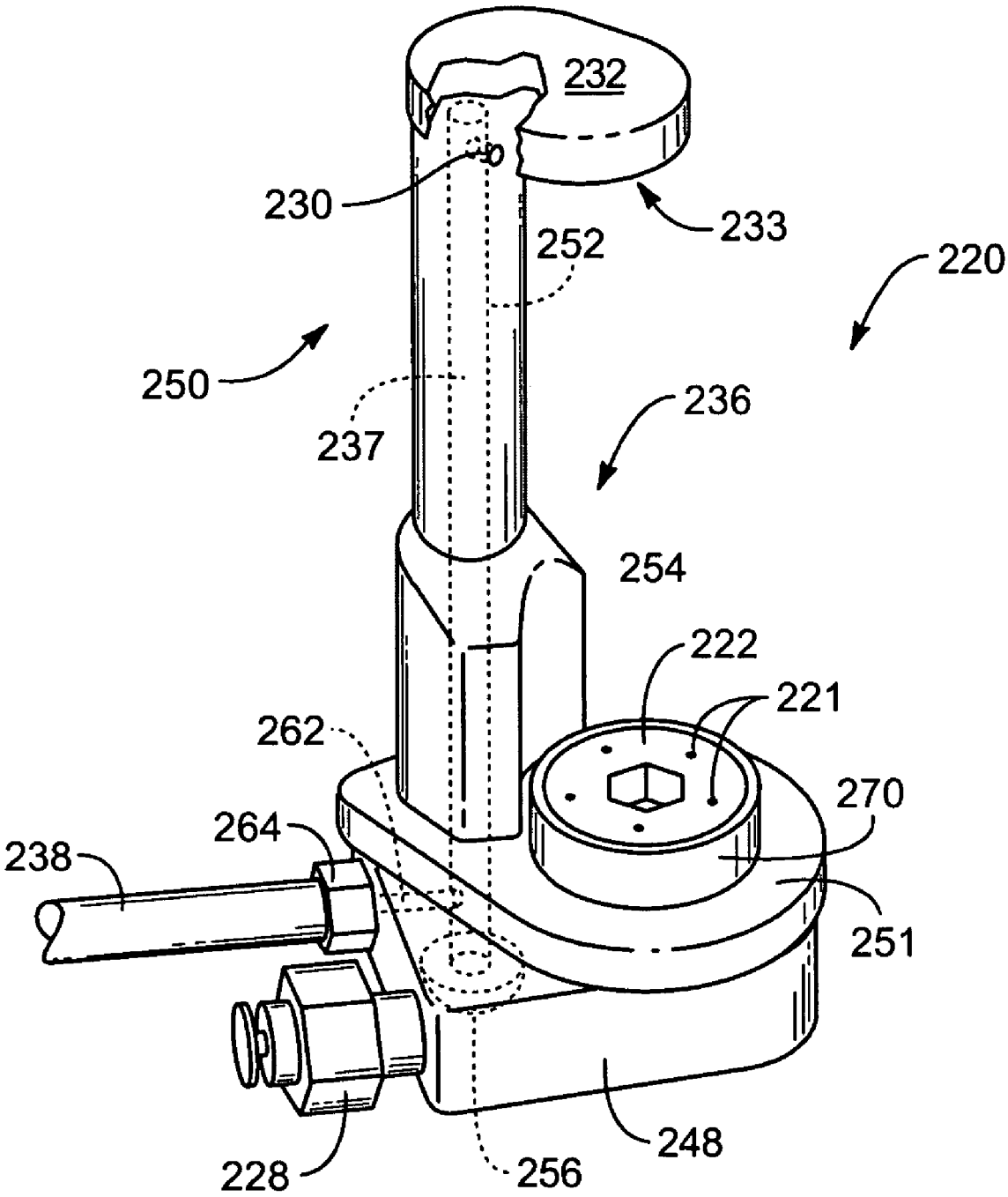
FIG. 8 is a perspective view of an alternative embodiment of a manifold in accordance with the present invention.

Referring now to FIG. 8, an additional embodiment of a manifold in conjunction with the present method and system is designated as 220. The manifold 220 has a base 248 wherein a single well 270 is presented. The single well 270 is configured to accommodate a nozzle 22 with a plurality of outlet apertures 221.

The base 248 also has an nitrous oxide inlet 228 which can receive nitrous oxide from a vessel or other source of pressurized oxygen enhancer. The nitrous oxide is then sprayed through the outlet apertures 221 and into the air box. The target plate 232 positioned on the neck 252 of the arm 250 deflects a portion of the gas into the port 230 and the remainder of the gas into the air intake to mix with air. The captured pressurized gas exerts a pressure that can be transferred through the hollow stem 236 of the arm 250 to the base where it is delivered to the fuel control device via pressure outlets 262, fittings 264, and transmission lines.

In the illustrated embodiment a single port 230 is provided in the arm 250. The arm 250 has a foot 251 and a stem 236 constructed from separate parts. However, it is anticipated that the entire arm 250 can be constructed from a single piece. The foot 251 can be constructed from aluminum or other materials selected for cost, strength, and weight. However, it will be appreciated that the arm 250, including the foot 251 and the stem 236, could be constructed from a single piece of a polymeric or thermally insulating material. Likewise, the nozzle 222 is constructed from a polymeric or other thermally insulating material and secured within the well 270. However it is anticipated that the nozzle 222 and outlet apertures 221 could be an integrated part of the arm as in the embodiment of FIG. 7. A hollow bolt 256 can be used to join the base 248 to the arm 250 and to deliver the captured gas from the stem 236 to the outlet 262.

I claim:

1. A method of increasing the power output of an internal combustion engine comprising: injecting a quantity of pressurized nitrous oxide into an air intake of the internal combustion engine through one or more apertures in a nozzle constructed from a thermally insulating material; sensing the amount of nitrous oxide injected into the air intake; and increasing flow of fuel to the internal combustion engine in a proportionate response to the amount of nitrous oxide injected into the air intake as sensed by the sensor.

2. The method of claim 1, wherein the nitrous oxide is in a liquid phase prior to the injecting and transitions to a gaseous phase upon the injecting.

3. The method of claim 2, further comprising mixing the gaseous nitrous oxide with air contained in the air intake.

4. The method of claim 3, wherein the sensing comprises transmitting a pressure exerted by the gaseous nitrous oxide to a fuel control device.

5. The method of claim 4, wherein the fuel control device is selected from the group consisting of a fuel float bowl of a carburetor, a fuel pressure regulator, an altitude compensating device, and an electronic sensor.

6. The method of claim 1, wherein the one or more apertures are configured to prevent nitrous oxide phase change prior to passing through the aperture.

7. A method for delivering a proportioned quantity of nitrous oxide and fuel to an internal combustion engine comprising: injecting a quantity of nitrous oxide into an air intake of the internal combustion engine, the injected nitrous oxide increasing pressure within the air intake adjacent the injection; applying the increased pressure to a fuel float bowl of the internal combustion engine; the increased pressure on the fuel float bowl resulting in an increased flow of fuel to the engine proportionate to the quantity of nitrous oxide injected into the air intake.

8. The method of claim 7, wherein the nitrous oxide is injected into the air intake portion of the engine through one or more apertures in a nozzle constructed from a thermally insulating material.

9. The method of claim 8, wherein the one or more apertures are configured to prevent nitrous oxide phase change prior to passing through the aperture.

10. The method of claim 7, wherein the nitrous oxide is in a liquid phase prior to the injecting and transitions to a gaseous phase upon the injecting.

11. A manifold for delivering nitrous oxide to an air intake of an internal combustion engine comprising: a nitrous oxide inlet configured to be attached to a vessel of nitrous oxide; a nozzle in fluid communication with the nitrous oxide inlet, the nozzle configured to spray nitrous oxide into the air intake through one or more apertures; a pressure port configured to capture a portion of a localized pressure increase resulting from sprayed nitrous oxide; and a pressure conduit in fluid communication with the pressure port, the pressure conduit configured to deliver the pressure to a fuel control device.

12. The manifold of claim 11, wherein the fuel control device is selected from the group consisting of a fuel float bowl of a carburetor, a fuel pressure regulator, an altitude compensating device, and an electronic sensor.

13. The manifold of claim 11, further comprising a target plate positioned proximate to the pressure port and configured to direct the pressure into the pressure port.

14. The manifold of claim 11, further comprising a second nozzle in fluid communication with the nitrous oxide inlet, the second nozzle configured to spray pressurized nitrous oxide into the air intake through at least one aperture.

15. The manifold of claim 14, further comprising a target plate distally positioned from the one or more apertures.

16. The manifold of claim 15, wherein the target plate is configured to direct a portion of the pressurized nitrous oxide into the pressure port.

17. The manifold of claim 11, further comprising a bleeder valve in fluid communication with the pressure conduit.

18. The manifold of claim 11, wherein the nozzle is made from a thermally insulating material.

19. The manifold of claim 18, wherein the thermally insulating material is selected from the group consisting of plastic, fiberglass, wood, cellulose, carbon fiber, ceramic, rubber, and a combination thereof.

* * * * *